US007918061B2

(12) United States Patent
Jackson et al.

(10) Patent No.: US 7,918,061 B2
(45) Date of Patent: Apr. 5, 2011

(54) MODULAR BASEMENT AIR CIRCULATION AND FINISHING SYSTEM

(75) Inventors: Todd Jackson, Belleville, MI (US); Robert Luke Secrest, Paraskala, OH (US); Douglas Clark Secrest, Blacklick, OH (US)

(73) Assignee: Advanced Basement Products, Reynoldsburg, OH (US)

( * ) Notice: Subject to any disclaimer, the term of this patent is extended or adjusted under 35 U.S.C. 154(b) by 385 days.

(21) Appl. No.: 12/024,471

(22) Filed: Feb. 1, 2008

(65) Prior Publication Data

US 2009/0193739 A1 Aug. 6, 2009

(51) Int. Cl.
*F24F 7/007* (2006.01)
*E04B 2/28* (2006.01)
*E04B 2/92* (2006.01)

(52) U.S. Cl. ..... 52/302.3; 52/220.3; 52/241; 52/586.2; 454/245; 454/249

(58) Field of Classification Search ..... 52/302.3, 52/302.1, 220.2, 220.3, 241, 238.1, 585.1, 52/586.2, 586.1, 582.1; 454/251, 241, 245, 454/249, 237, 252

See application file for complete search history.

(56) References Cited

U.S. PATENT DOCUMENTS

| | | | | |
|---|---|---|---|---|
| 879,520 | A * | 2/1908 | Chantigney et al. | 52/302.3 |
| 2,074,370 | A * | 3/1937 | Coulton | 454/185 |
| 2,210,960 | A * | 8/1940 | St Pierre | 454/185 |
| 4,628,650 | A * | 12/1986 | Parker | 52/265 |
| 5,000,808 | A | 3/1991 | Deviney | |
| 5,787,651 | A * | 8/1998 | Horn et al. | 52/144 |
| 6,176,054 | B1 | 1/2001 | Allen et al. | |
| 6,691,427 | B1 * | 2/2004 | Fernandes et al. | 454/186 |
| 2003/0079428 | A1 * | 5/2003 | Rivers | 52/270 |
| 2006/0236653 | A1 * | 10/2006 | Showers | 52/794.1 |
| 2007/0261364 | A1 * | 11/2007 | Ritchie | 52/783.1 |
| 2008/0171203 | A1 * | 7/2008 | Maddan | 428/402 |

* cited by examiner

*Primary Examiner* — Michael Safavi
(74) *Attorney, Agent, or Firm* — Harness, Dickey & Pierce, P.L.C.

(57) ABSTRACT

A seamless wall finishing system has a plurality of wall panels which are spaced apart from an exterior wall. The spacing creates an air gap which provides an airflow passage between the exterior wall and the second surface of the wall panels. The wall panels have a mold resistant non-organic thread or yarn wall covering which is adhered to a central portion of a first surface of each of the wall panels. The wall panels define a pair of uncovered areas on opposite sides of each of the plurality of wall panels. A vertically extending seam is created between adjacent wall panels which is filled with a seam tape made from the mold resistant nylon yarn wall covering. An air circulation system is provided for circulating air behind the wall panels. A method of assembling the modular basement wall finishing system is also provided.

6 Claims, 4 Drawing Sheets

MODULAR BASEMENT AIR CIRCULATION AND FINISHING SYSTEM

FIELD

The present disclosure relates to modular wall finishing systems. More particularly to a modular basement wall finishing system having a seamless wall structure.

BACKGROUND

The statements in this section merely provide background information related to the present disclosure and may not constitute prior art.

Commercial wall systems are used for finishing many types of interior spaces. Typically these wall systems are installed between a floor and a ceiling surface using a large quantity of framing members. Additionally, when the wall system is installed, insulation is often used to increase thermal efficiency. The framing members and insulation create a complex installation process, increase cost, and inhibit removal for future use of the wall system in a different space or location.

Typically these systems are used in buildings having porous block or poured concrete walls that can retain unwanted moisture and wick the moisture into the living space. This unwanted moisture is often trapped in a confined space between the exterior walls and the interior walls which creates harmful mold. The mold and moisture eventually cause permanent damage to the interior walls, framing members, and insulation which prevents reuse and requires replacement of these components.

Therefore, there has been and continues to be a need for a modular wall system that has little complexity and provides moisture and mold resistant qualities as well as improving thermal efficiency.

SUMMARY

The present disclosure is directed to a seamless wall finishing system, having a series of wall panels which are spaced apart from the exterior walls. The spacing creates an air gap between the wall panels and the exterior walls to provide an airflow passage between the exterior wall and the backside of the wall panels.

In another embodiment of the present disclosure, a mold resistant non-organic thread or yarn wall covering that can include nylon, fiberglass, polyester, etc. is adhered to a central portion of a first surface of each of a plurality of wall panels. A perimeter of the first surface of each of the plurality of wall panels has an uncovered area such that when a first of the plurality of wall panels is mounted adjacent a second of the plurality of wall panels a vertically extending seam is defined. A mold resistant non-organic thread or yarn seam tape is then adhered to the vertically extending seam.

A method of assembling a modular basement wall finishing system is also provided.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
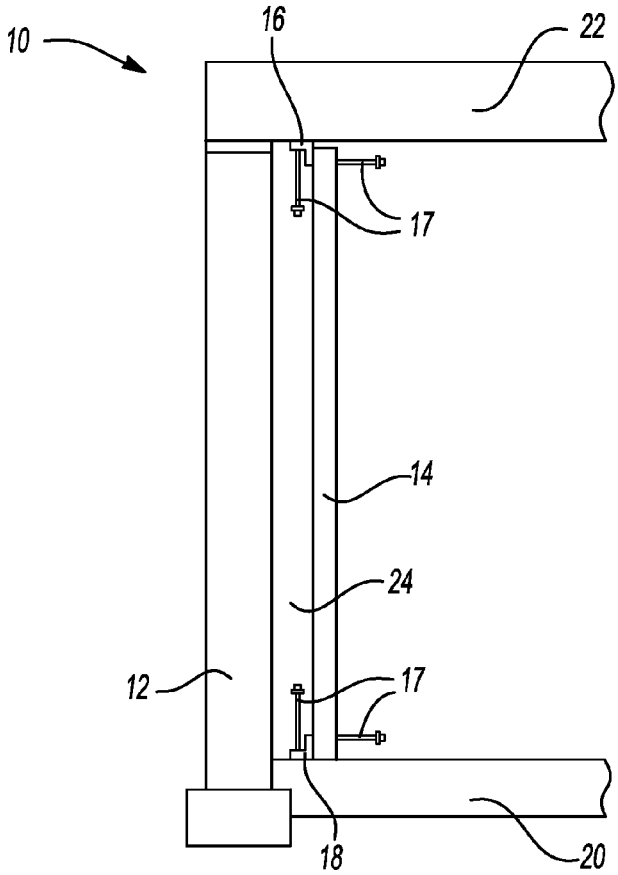
FIG. 1 is a partial cross-sectional view of the modular basement finishing system according to the present disclosure.

The following description is merely exemplary in nature and is not intended to limit the present disclosure, application, or uses. It should be understood that throughout the drawings, corresponding reference numerals indicate like or corresponding parts and features.

With reference to FIG. 1, a modular basement finishing system is depicted generally by reference number 10. As will be discussed, the modular basement finishing system 10 is designed to be erected and detachably secured between a floor structure 20 and a ceiling structure 22. The modular basement finishing system 10 may be spaced away from the basement foundation wall 12 which may allow air to flow through an airflow passage 24 between the basement foundation wall 12 and the modular basement wall finishing system 10. It is understood that the modular basement finishing system 10 may be spaced away from the basement foundation wall 12 at an appropriate interval to achieve a desired airflow. In a preferred embodiment, an elongated floor railing 18 may be detachably secured to the floor structure 20 using fasteners 17. The elongated floor railing 18 is typically constructed of metal or any other suitable materials. An elongated ceiling railing 16 may be detachably secured to a ceiling structure 22 using fasteners 17. The elongated ceiling railing 16 is typically constructed of metal or any other suitable material. The ceiling structure 22 may include joists, rafters, or any other suitable structure for retaining fasteners 17. The elongated ceiling railing 18 is typically constructed of metal angle iron or any other suitable material. A wall panel 14 is vertically positioned adjacent the elongated floor railing 18 and the elongated ceiling railing 16. The wall panel 14 may be detachably secured to the elongated ceiling railing 16 using fasteners 17. Additionally, the wall panel 14 may be detachably secured to the elongated floor railing 18 using fasteners 17. It is understood that the wall panel 14 may also be detachably secured to the elongated floor railing 18 and the elongated ceiling railing 16 using any method of detachably securing wall panels 14 known in the art.

Figure 2:
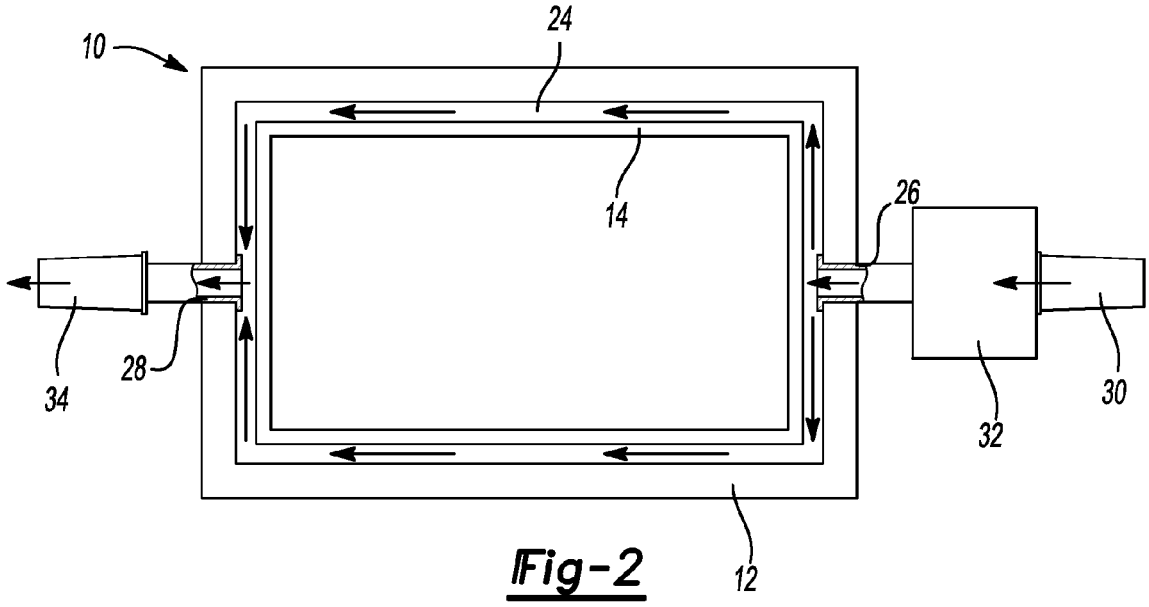
FIG. 2 is a schematic view of the modular basement finishing system illustrating an air gap and ventilation system according to the principles of the present disclosure.
Figure 3:
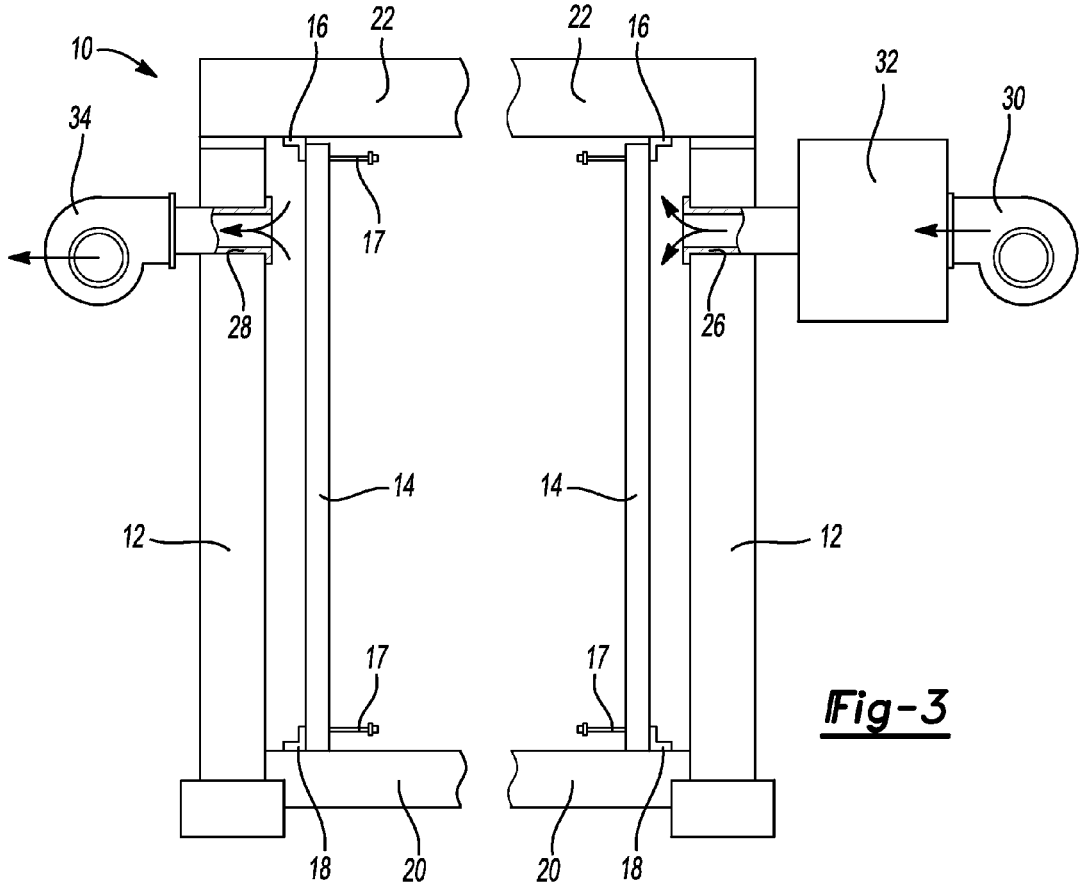
FIG. 3 is a partial cross-sectional view of the modular basement finishing system further illustrating the air gap and ventilation system depicted in FIG. 2.

With reference to FIGS. 2 and 3, the modular basement finishing system may include an air inlet aperture 26 in communication with the airflow passage 24 that is provided between the foundation wall 12 and wall panels 14. Although the air inlet aperture 26 may be located in an exterior wall 12 as depicted in FIG. 2, the air inlet aperture 26 may also be located in a wall panel 14, the ceiling structure 22 or any other suitable area for locating an air inlet aperture 26 to allow communication with the airflow passage 24. The modular basement finishing system 10 may further include an air outlet aperture 28 in communication with the airflow passage 24. Although the air outlet aperture 28 may be located in an exterior wall 12 as depicted in FIG. 2, the air outlet aperture 26 may also be located in a wall panel 14, the ceiling structure 22 or any other suitable area for locating an air outlet aperture 26 to allow communication with the airflow passage 24.

The modular basement finishing system 10 may further include a dehumidifier 32 which may be in communication with the airflow passage 24. The dehumidifier 32 may reduce the moisture from the airflow entering the airflow passage 24. It is understood that a dehumidifier 32 may be any device suitable for removing moisture from the air. Although the dehumidifier 32 is shown on the outside of an exterior wall 12, the dehumidifier 32 may be installed on either side of the wall panels 14 including within the airflow passage 24. The dehumidifier 32 may also be installed anywhere suitable for maintaining communication with the air inlet aperture 26. FIG. 2 further illustrates a blower 30 in communication with the airflow passage 24 and the dehumidifier 32. The blower 30 may provide air to the dehumidifier 32. The blower 30 may also be attached between the air inlet aperture 26 and the dehumidifier 32. In this configuration the blower 30 may draw dehumidified air from the dehumidifier 32 or may force air through the dehumidifier 32. Alternatively, the blower 30 may be integral to the air inlet aperture 26 or the dehumidifier 32 or connected to the dehumidifier 32 by any means known in the art. Additionally, FIG. 2 illustrates an exhaust blower 34 in communication with the airflow passage 24. The exhaust blower 34 may be attached to the air outlet aperture 28. Alternatively, the exhaust blower 34 may be integral to the air outlet aperture 28 or connected to the air outlet aperture 28 by any means known in the art.

Figure 4:
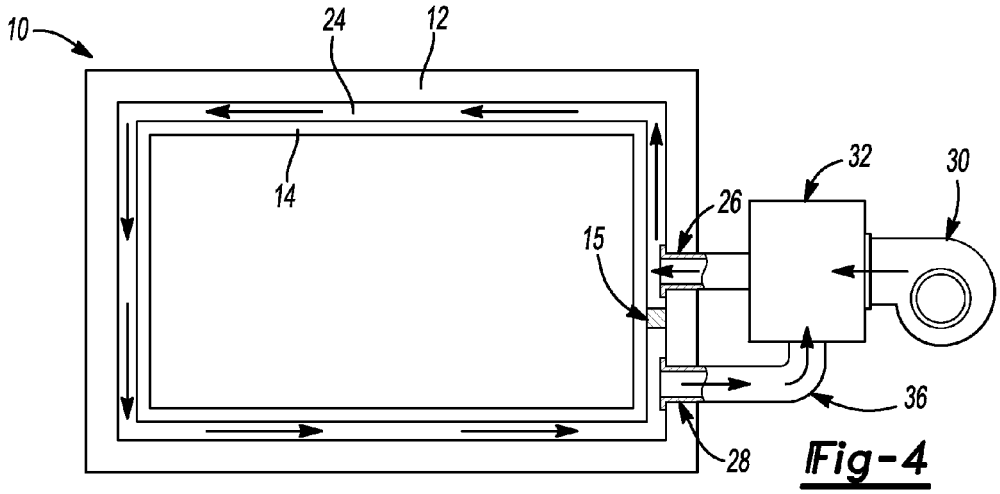
FIG. 4 is a schematic view of the modular basement finishing system illustrating an alternative air gap and ventilation system.

With reference to FIG. 4, another embodiment of the modular basement finishing system 10 is provided wherein the air inlet aperture 26 and the air outlet aperture 28 are located adjacently. A vertically extending baffle 15 may be installed between the exterior wall 12 and a wall panel 14. The vertically extending baffle 15 may be positioned substantially between the air inlet aperture 26 and the air outlet aperture 28 and may provide an airflow barrier there between. The vertically extending baffle 15 may begin at the floor structure 20 and continue to the ceiling structure 22, shown in FIG. 3. The vertically extending baffle 15 may be made of any suitable material known in the art. The vertically extending baffle 15 may adhere to the wall panel 14 and the exterior wall 12. Alternatively, the vertically extending baffle 15 may be fastened or sealed to the wall panel 14 and the exterior wall 12. The vertically extending baffle 15 may provide uni-directional airflow through the airflow passage 24. The vertically extending baffle 15 may also be formed integrally to the wall panel 14. The vertically extending baffle 15 may also attach to the elongated ceiling railing 16 and the elongated floor railing 18.

Additionally, FIG. 4 illustrates an elbow connector 36 attached to the air outlet aperture 28 and the dehumidifier 32. The elbow connector 36 may provide a closed loop connection to allow the dehumidifier 32 to reuse the air exiting the air outlet aperture 28 where it is desirable to reduce the workload of the dehumidifier 32 in high humidity conditions. Although the air exiting the air outlet aperture 28 may have a greater moisture content than the air entering the air inlet aperture 26, it may be a lower moisture content than atmospheric air and thus reduce the workload and energy consumption of the dehumidifier 32 and the blower 30 where an open loop system is used. It should be understood that the closed loop configuration may allow the dehumidifier 32 and the blower 30 to be configured in any orientation between the air inlet aperture 26 and the air outlet aperture 28. Additionally, where the air inlet aperture 26 and the air outlet aperture 28 are formed, for example in one of the wall panels 14, the dehumidifier 32, blower 30, elbow connector 36, and exhaust blower 34 can be also be located inside of the interior space created by the wall panels 14. The dehumidifier 32, blower 30, elbow connector 36, and exhaust blower 34 can be located anywhere that is suitable for communicating with the airflow passage 24, for example in a utility closet or a mechanical room.

Figure 5:
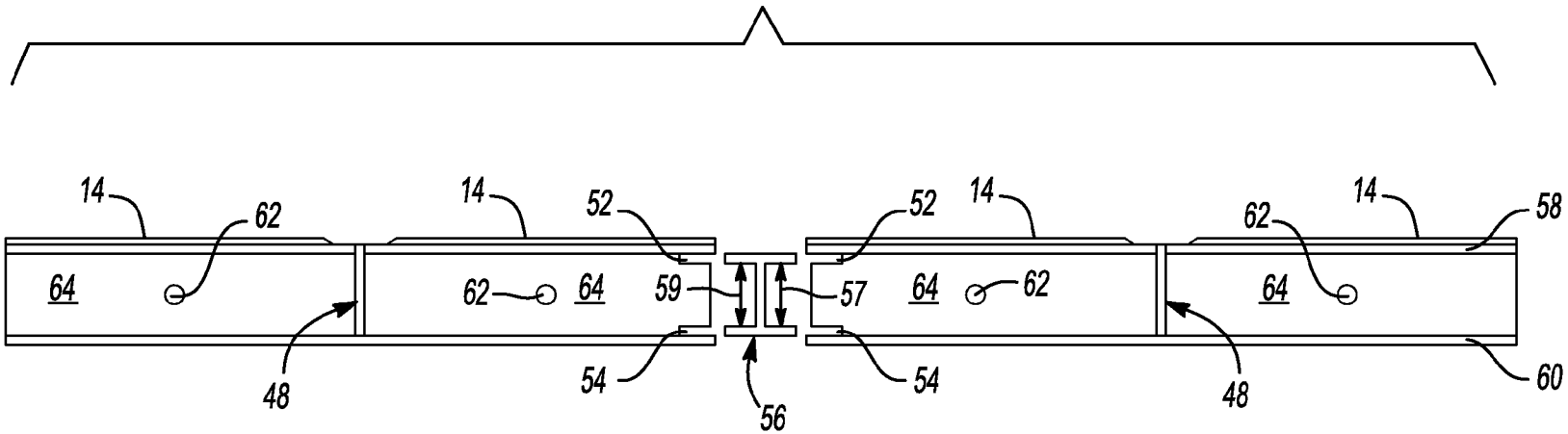
FIG. 5 is a plan view of a series of adjoining wall panels illustrating the "H-Clip" attachment method.

With reference to FIG. 5, each wall panel 14 may have an inner foam structure 64 which may provide each wall panel 14 with an insulation value which may increase the temperature and comfort level of a basement or any other suitable type of building. The inner foam structure 64 can be made from material such as closed cell foam or any other suitable material known in the art. The inner foam structure 64 may have mechanical properties capable of loading the wall panel 14 with additional structure, for example, shelving and audio/video equipment. The inner foam structure 64 may have apertures 62 formed therein which may receive an electrical conduit which may supply electricity to outlets and switches in each of the wall panels 50. Each wall panel 14 may have an aperture 62 formed in substantially the same location so that electrical conduit can be received by the aperture 62 formed in each wall panel 14. The aperture 62 may be suitable to receive other mechanical or electrical hardware as desired. For example, plumbing conduit may also be installed in the aperture 62.

The inner foam structure 64 may have a first mineral board 58 applied to a first surface of the inner foam structure 64. The inner foam structure 64 may also have a second mineral board 60 applied to a second surface of the inner foam structure 64. The first mineral board 58 and the second mineral board 60 may be made of any suitable materials known in the art. The first mineral board 58 and the second mineral board 60 may be adhered to the inner foam structure 64, attached with fasteners or secured using any other suitable means known in the art. The first mineral board 58 and the second mineral board 60 may be structurally reinforced with a fiberglass mesh or any other suitable reinforcement material.

A panel biscuit or H-clip 56 may be used to secure adjacent wall panels 14. The H-clip 56 allows the adjoining wall panels 14 to be rigidly attached and may eliminate the need for reinforcing frame members. The H-clip 56 may be made from metal, plastic, composite or any other suitable material. The H-clip 56 may be configured in any orientation that may secure adjoining wall panels 14. A first pocket 52 in the wall panel 14 may be formed by sliding a knife in between the inner foam structure 64 and the back side of the first mineral board 58. Next, a second pocket 54 may be formed in the wall panel 14 by sliding a knife in between the inner foam structure 64 and the back side of the second mineral board 60 at substantially the same vertical position as the first pocket 52. The first end 57 of the H-clip 56 may be installed in the first pocket 52 and the second pocket 54. Next, a first pocket 52 and a second pocket 54 of an adjacent panel are formed to receive a second end 59 of the H-clip 56. The adjoining wall panels 14 are then abutted such that the second end 59 of the H-clip 56 is inserted into the first pocket 52 and the second pocket 54 of the adjacent wall panel 14. The wall panels 14 are detachably secured to the elongated floor railing 18 and the elongated ceiling railing 16 using fasteners 17. The wall panels 14 can be detached by removing the fasteners 17 and separating the adjoining wall panels 17. A single H-clip 56 may also be pre-installed on one side of each wall panel 14 before the wall panels are shipped to the work site to reduce the quantity of on-site installation steps.

Figure 6:
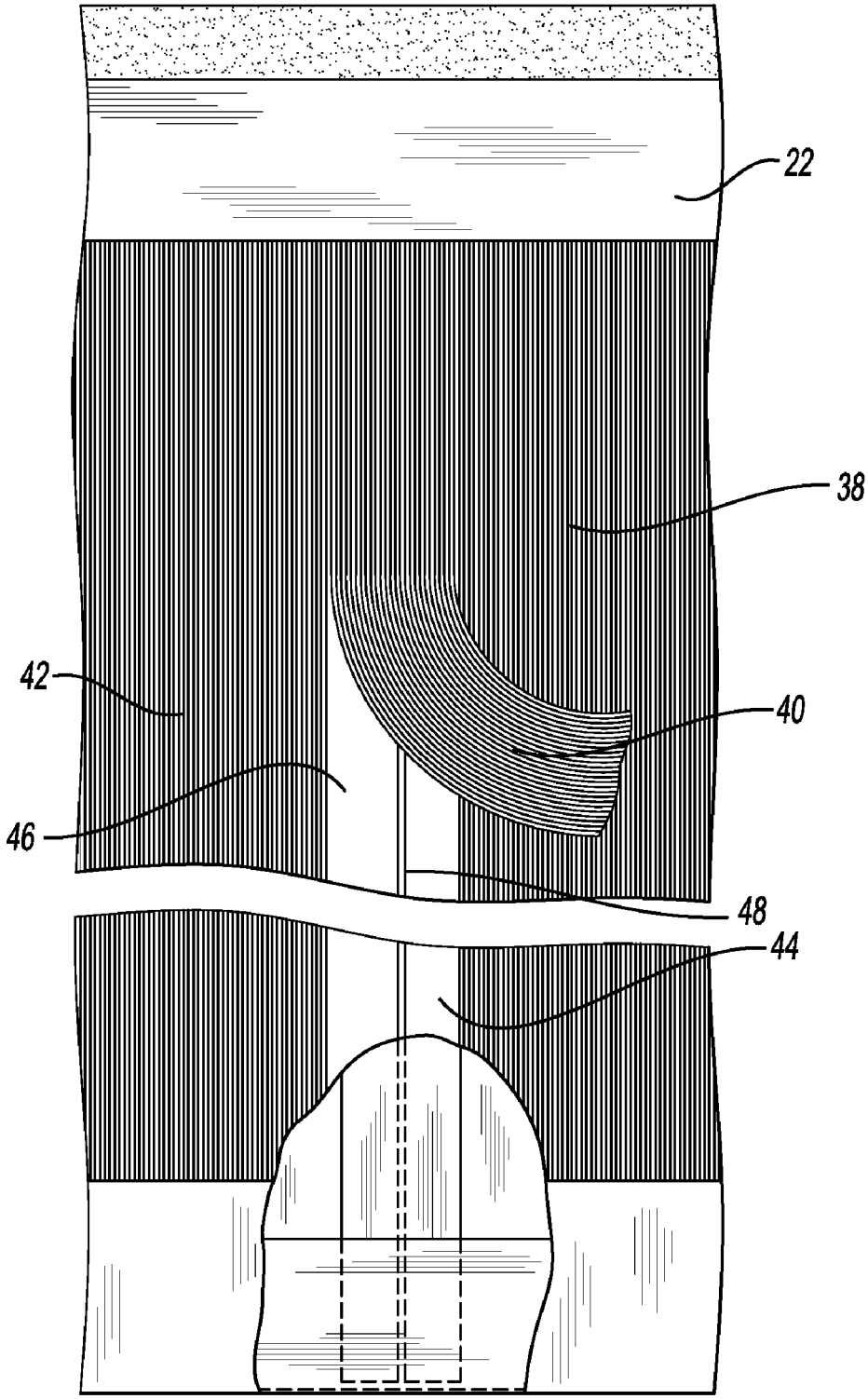
FIG. 6 is a fragmentary side elevation view of a portion of the modular basement finishing system showing the application of the seam tape into a vertically extending seam created by adjoining sheets of mold resistant non-organic thread or yarn wall coverings.

With reference to FIG. 6, each wall panel 14 may have a pre-applied mold resistant nylon yarn wall covering 38 (wall covering). The wall covering may begin at the ceiling structure 22 and terminate at any desired location such as a chair rail trim or base molding trim (not shown). The wall covering 38 may have an anti-microbial film or may have an anti-microbial paint. The wall covering 38 may also use any suitable material for reducing moisture build up and mold formation known in the art. The wall covering 38 may have a grain pattern and a gloss level that may be designed to be aesthetically pleasing and functional. The grain pattern and the gloss level may provide functionality by hiding scuff marks, for example. Further, the seam tape 40 may have similar or substantially the same grain pattern and gloss level as the wall covering 38. The seam tape 40 may provide a seamless appearance when adhered between adjacent wall coverings 38 and 42 or patching a damaged area by cutting and removing the damaged area, then creating a patch and adhering it to the wall panel 14. The wall covering 38 may have a series of non-organic thread or yarn strands embedded therein. The series of non-organic thread or yarn strands may also be disposed on the first surface of the wall covering 38. The non-organic thread or yarn strands may form or impart a grain pattern on the wall covering 38 and the seam tape 40. The grain pattern may aid the installer in joining the terminal edges of the seam tape 40 to the terminal edges of the wall covering 38. The non-organic thread or yarn strands may also provide a uniform vertical line if trimming of the wall covering 38 or the seam tape 40 becomes necessary, for example, where a partial wall panel 14 is installed adjacent a full wall panel 14, the wall covering 38 will need to be removed from one side of the partial wall panel 14 to create a first uncovered area 44. The seam tape 40 may be applied over the joint 48 created by adjoining wall panels 14 and to the first uncovered areas 44 and 46. The seam tape 40 may be any width suitable to cover the first uncovered areas 44 and 46. The seam tape 40 may have an anti-microbial film or may have an anti-microbial paint. The seam tape 40 may contain any suitable material for reducing moisture build up and mold formation known in the art. The seam tape 40 adhesive may be heat and pressure sensitive or self-adhering.

What is claimed is:

1. A wall finishing system, comprising:

a plurality of wall panels each having a first surface and a second surface, the second surface is spaced from an exterior wall, wherein the second surface of the plurality of wall panels define an air gap between the second surface and the exterior wall to provide an airflow passage between the exterior wall and the second surface of the plurality of wall panels, an air inlet aperture in communication with the air gap; and an air outlet aperture in communication with the air gap;

a blower in communication with the air inlet aperture to facilitate an airflow from the air inlet aperture to the air outlet aperture;

wherein the air inlet aperture and the air outlet aperture are disposed adjacently and separated by a vertically extending baffle disposed between the exterior wall and one of the plurality of wall panels, the vertically extending baffle provides a uni-directional airflow between the plurality of wall panels and the exterior wall.

2. The wall finishing system of claim 1, further comprising:

an elongated floor railing having a first leg adapted to mount to a floor surface and a second leg adapted to mount to the plurality of wall panels; and an elongated ceiling railing having a first leg adapted to mount to a ceiling surface and a second leg adapted to mount to the plurality of wall panels.

3. The wall finishing system of claim 1, wherein the plurality of wall panels further comprise:

an inner foam structure having apertures formed therein and adapted to receive an electrical conduit;

a first mineral board and a second mineral board reinforced with a mesh fabric wherein the first mineral board is adhered to a first surface of the inner foam structure and the second mineral board is adhered to a second surface of the inner foam structure.

4. The wall finishing system of claim 3, further comprising:

a plurality of H-clips adapted to penetratingly engage a surface between the inner foam structure and the first and the second mineral boards wherein the H-clips provide a structural integrity between each of the plurality of wall panels.

5. The wall finishing system of claim 1, further comprising:

a dehumidifier in communication with the blower.

6. The wall finishing system of claim 5, wherein the air outlet aperture is in communication with the dehumidifier and an outlet of the dehumidifier is connected to the air inlet aperture to provide a closed loop dehumidified airflow entering the air inlet aperture.

* * * * *